US009162490B2

(12) United States Patent
Nagashima

(10) Patent No.: US 9,162,490 B2
(45) Date of Patent: Oct. 20, 2015

(54) SHEET SUPPLY APPARATUS AND PRINTING APPARATUS

(71) Applicant: CANON KABUSHIKI KAISHA, Tokyo (JP)

(72) Inventor: Masakazu Nagashima, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/840,163

(22) Filed: Mar. 15, 2013

(65) Prior Publication Data

US 2013/0257958 A1 Oct. 3, 2013

(30) Foreign Application Priority Data

Mar. 30, 2012 (JP) ..... 2012-082680

(51) Int. Cl.

| | |
|---|---|
| ***B41J 29/38*** | (2006.01) |
| ***B41J 11/00*** | (2006.01) |
| ***B41J 11/42*** | (2006.01) |
| *B41J 13/00* | (2006.01) |
| *B41J 15/04* | (2006.01) |
| *B41J 13/10* | (2006.01) |

(52) U.S. Cl.

CPC ..... *B41J 11/009* (2013.01); *B41J 11/42* (2013.01); *B41J 15/042* (2013.01); *B41J 13/0009* (2013.01); *B41J 13/103* (2013.01); *B41J 15/048* (2013.01)

(58) Field of Classification Search

CPC ..... B41J 13/0009; B41J 15/04; B41J 11/002; B41J 29/38; B41J 11/0095; B41J 11/0085; B41J 11/06; B41J 11/007; B41J 11/0005; B41J 3/01; G02B 5/201; G06K 1/121; C04B 41/009; G02F 1/133516

See application file for complete search history.

(56) References Cited

FOREIGN PATENT DOCUMENTS

| | | | |
|---|---|---|---|
| JP | 8-175709 | A | 7/1996 |
| JP | 2004-168514 | A | 6/2004 |
| JP | 2010-201701 | A | 9/2010 |
| JP | 2010-264672 | A | 11/2010 |

OTHER PUBLICATIONS

JP2004168514 A (Machine Translation), Jun. 17, 2004 Entire Document.*

JP2010264672 A (Machine Translation), Nov. 2010, Entire Document.*

* cited by examiner

*Primary Examiner* — Lisa M Solomon

(74) *Attorney, Agent, or Firm* — Canon U.S.A., Inc., IP Division

(57) ABSTRACT

A sheet supply apparatus includes a supply unit capable of loading a plurality of continuous sheets, a reading unit for reading sheet information that a continuous sheet has, and a control unit that, when the continuous sheet is loaded on the supply unit, enables the reading unit to read the sheet information in a first state and provides a notification to prompt an input of the sheet information in a second state, the first state being the state in which the reading of the sheet information by the reading unit is available, the second state being the state in which the reading of the sheet information by the reading unit is unavailable.

7 Claims, 11 Drawing Sheets

SHEET SUPPLY APPARATUS AND PRINTING APPARATUS

BACKGROUND OF THE INVENTION

1. Field of the Invention

The present invention relates to a sheet supply apparatus for supplying a continuous sheet and to a printing apparatus.

2. Description of the Related Art

There is a printer known to print on a continuous sheet in a roll form (roll sheet) through an inkjet method. When having mounted a new roll sheet on a printer, a user would input the type of the roll sheet from an operating unit of the printer to associate the roll sheet with its type. The type of the roll sheet that has been input is used for succeeding image forming and convey controlling. When the roll sheet is removed from a mounting unit of the printer, a pattern (hereinafter referred to as barcode), which identifies the type of the sheet, is printed on the roll sheet at an end of the sheet (at the leading edge thereof) in order to retain the association between the roll sheet and its type. When the roll sheet with the barcode printed thereon is mounted on the mounting unit of the printer, the printer reads the barcode to set the type of the sheet automatically, eliminating a demand for the user to input the type of the roll sheet again.

A printer, disclosed in Japanese Patent Application Laid-Open No. 2010-264672, allows for replacing of a roll sheet unused for printing during the printing. When a roll sheet used for the printing is consumed, a replacement roll sheet is fed so that its barcode is read. If the type of the replacement roll sheet agrees with the type of the roll sheet used for the printing, the printing is continued. If the type of the replacement roll sheet disagrees with the type of the roll sheet used for the printing, the printing is suspended and an error is displayed.

The printer, described in Japanese Patent Application Laid-Open No. 2010-264672, allows a roll sheet to be mounted while another roll sheet is being printed. If, however, the type of the mounted roll sheet disagrees with the type of the roll sheet being printed, the printing operation is interrupted until the user mounts a roll sheet of the correct type.

If the mounted roll sheet lacks a barcode, or if its barcode is unreadable due to a stain or the like, it is problematic in that the type of the mounted roll sheet cannot be identified unless the user manually inputs information of the paper type. Furthermore, it is unknown whether or not the reading operation on the barcode of the mounted roll sheet has been executed until the roll sheet being printed is consumed and then the reading operation is attempted on the barcode. This leaves the printer unable to identify the type of the roll sheet if the user is away from the printer.

SUMMARY OF THE INVENTION

It is therefore an object of the present invention to provide an apparatus with an arrangement that, when a recording operation is being performed on a continuous sheet mounted on a first mounting unit, allows for mounting of another continuous sheet on a second mounting unit, the apparatus being capable of establishing information of the continuous sheet mounted on the second mounting unit at an early timing.

Another object of the present invention is to provide a sheet supply apparatus including a supply unit capable of loading a plurality of continuous sheets, a reading unit for reading sheet information that a continuous sheet has, and a control unit that, when the continuous sheet is loaded on the supply unit, enables the reading unit to read the sheet information in a first state and provides a notification to prompt an input of the sheet information in a second state, the first state being the state in which the reading of the sheet information by the reading unit is available, the second state being the state in which the reading of the sheet information by the reading unit is unavailable.

Further features of the present invention will become apparent from the following description of exemplary embodiments (with reference to the attached drawings).

DESCRIPTION OF THE EMBODIMENTS

Figure 1:
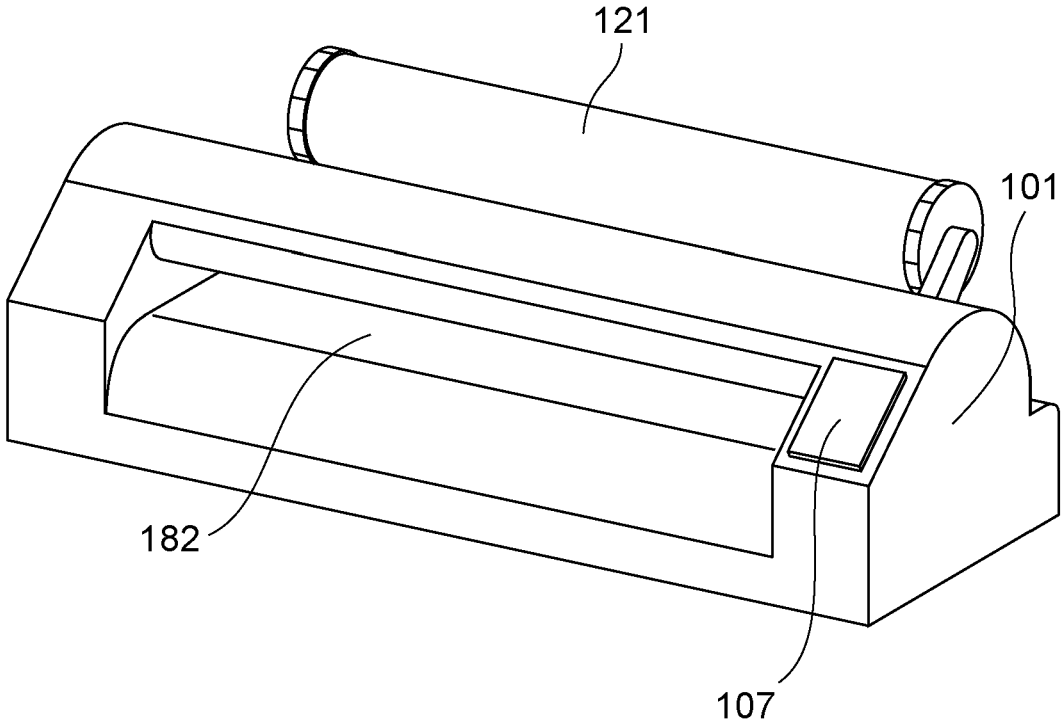
FIG. 1 is a front perspective view of a printing apparatus according to the present embodiment.
Figure 2:
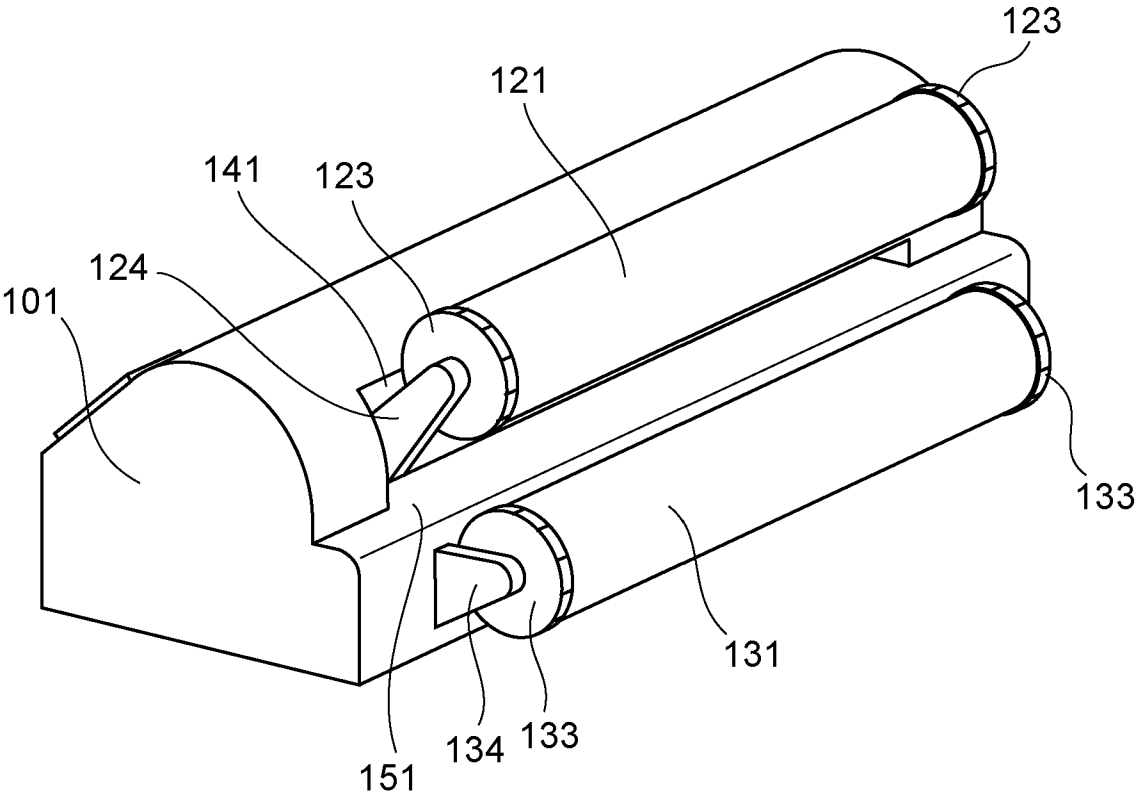
FIG. 2 is a rear perspective view of the printing apparatus according to the present embodiment.
Figure 4:
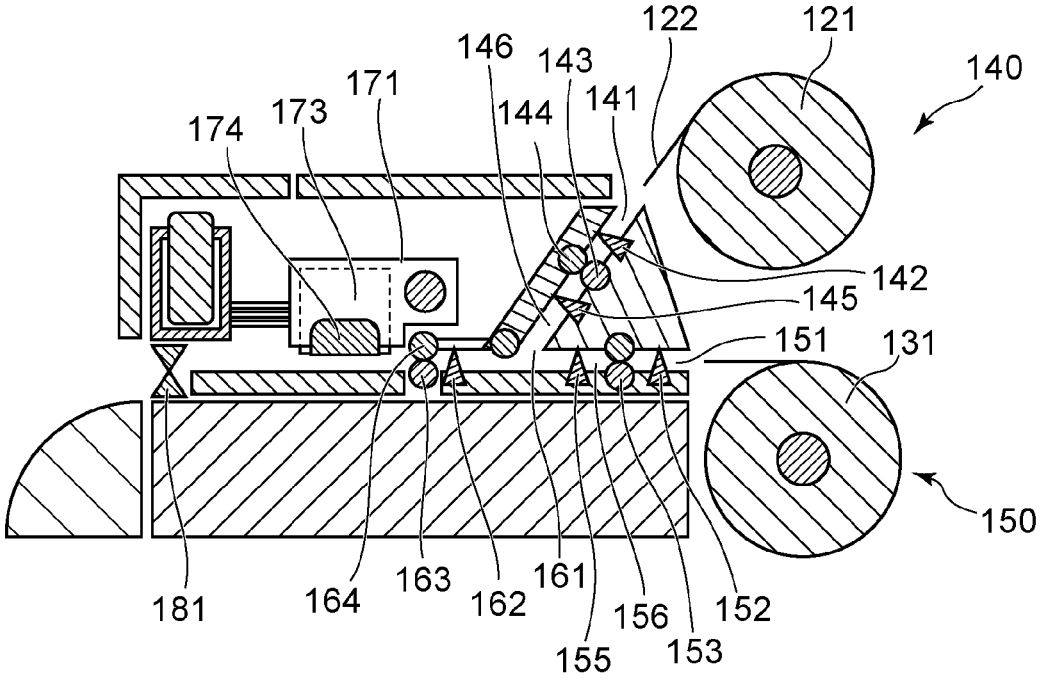
FIG. 4 is a sectional view of the printing apparatus according to the present embodiment.

Some embodiments of the present invention will now be described with reference to the drawings. FIGS. 1 and 2 are a front perspective view and a rear perspective view, respectively, of a printing apparatus with a sheet supply apparatus according to an embodiment of the present invention. FIG. 4 is a sectional view of the printing apparatus (an inkjet printer). Note that the present invention can be also applied to another type of printing apparatus besides an inkjet type. Furthermore, in addition to a printing apparatus, the present invention can be also applied to a sheet processing apparatus that includes a processing unit for performing various types of processing (preparation, coating, heat treatment, reading, or the like) other than printing on a supplied sheet.

With reference to FIG. 2, a printing apparatus 101 according to the present embodiment includes a first mounting unit (a supply unit) and a second mounting unit (a supply unit). The first mounting unit and the second mounting unit include spool supports 124 and 134 for supporting spools 123 and 133 of a roll sheet, respectively. The first spool 123 includes a pair of flanges on both sides thereof and a through shaft (not shown) coupling the flanges to retain a first roll sheet 121. Similarly, the second spool 133 includes a pair of flanges on both sides thereof and a through shaft (not shown) coupling the flanges to retain a second roll sheet 131. The first roll sheet 121 and the second roll sheet 131 are supplied to the inside of the printing apparatus through a first supply opening 141 and a second supply opening 151, respectively. Here, the printing apparatus may include three or more mounting units for mounting roll sheets. The first roll sheet 121, supplied from the first supply opening 141, is conveyed to a printing unit through a first supply path 146. The second roll sheet 131, supplied from the second supply opening 151, is conveyed to the printing unit through a second supply path 156. The first supply path 146 and the second supply path 156 join upstream of the printing unit.

Figure 3:
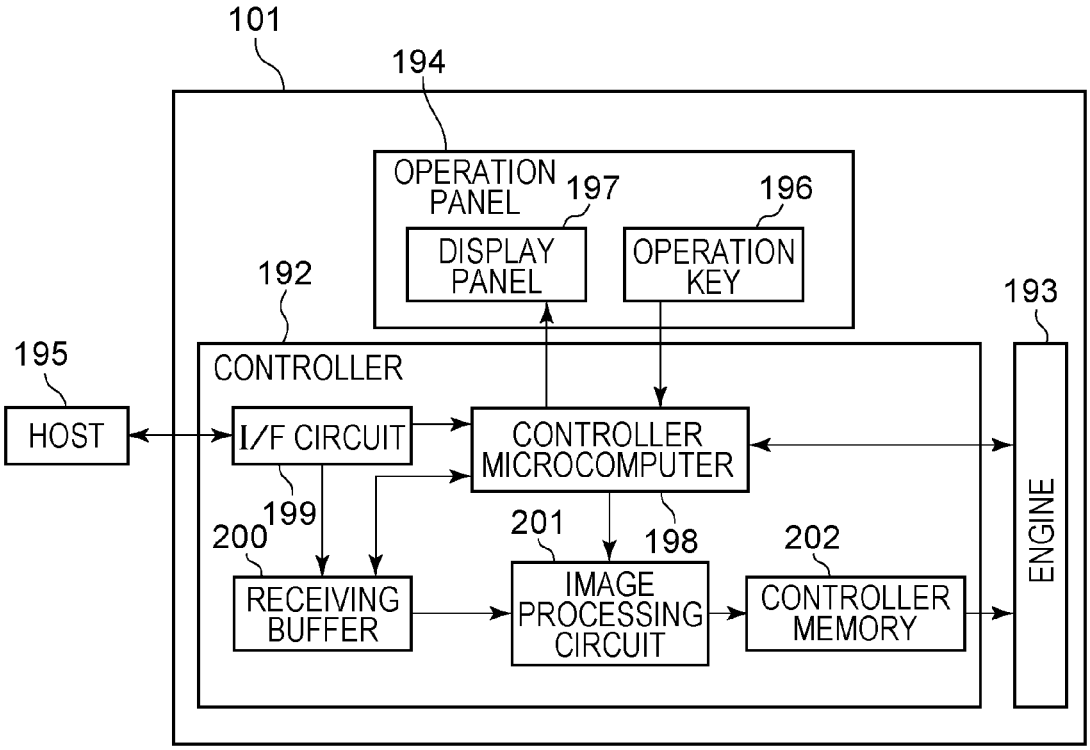
FIG. 3 is a block diagram of the present embodiment.

FIG. 3 is a block diagram of a control unit of the printing apparatus according to an embodiment of the present invention. With reference to this diagram, the control unit 101 includes a controller 192, an engine 193, and an operation panel 194. The controller 192 performs processing, such as analysis of a print job that is input from a host 195, in order to generate print data in a format printable by the engine 193. The operation panel 194 includes an operation key 196, which is an input unit, and a display panel 197, which is a notification unit. The operation key 196 allows a user to provide an input, such as for setting an operating environment for the printing apparatus. The display panel 197 displays a state of the printing apparatus, a prompt for an operation by the user through the operation key 196, and the like. The engine 193 controls feeding of a sheet, printing of an image based on the print data generated by the controller 192, discharging of the sheet, and the like. The engine 193 also enables various sensors to detect a status of conveying, printing, etc. of the sheet and sends a detection signal to the controller 192. Similarly, the controller 192 is also notified of various abnormalities, such as a jammed sheet and a lack of sheet, occurring at the engine 193. The controller 192 performs appropriate processing depending on a status, such as displaying a restoring instruction on the display panel 197 and notifying the host 195.

The controller 192 will now be described. Reference numeral 198 denotes a controller microcomputer, 199 an interface circuit (I/F circuit), 200 a receiving buffer, 201 an image processing circuit, and 202 a controller memory.

Processing such as the analysis of a print job that is input from the outside, image processing, and conversion processing into a bitmap is always performed under the control of the controller microcomputer 198.

The flow of the print data will now be described. A print job that is input from the host 195 is sent through the I/F circuit 199 to be stored in the receiving buffer 200. The I/F circuit 199 notifies the controller microcomputer 198 of the reception of the print job. The print job includes, in addition to image data, information such as a size and a type of the sheet. The controller microcomputer 198 analyzes the print job to provide an instruction to the image processing circuit 201 and the engine 193. The image data stored in the receiving buffer 200 undergoes the image processing by the image processing circuit 201 to be converted into a bitmap format, which is stored in the controller memory 202 and then sent to the engine 193.

An operation of the engine will now be described in detail. With reference to FIG. 4, a first feed sensor 142 and a first retract sensor 145 are arranged on the first supply path 146. A second feed sensor 152 and a second retract sensor 155 are arranged on the second supply path 156. The first supply path 146 and the second supply path 156 join into a convey path on which a conveying sensor 162 is arranged. Detection of a sheet by these sensors initiates a variety of control on a first feed roller 143, a second feed roller 153, and a conveying roller 163. Then, in order to print on the first roll sheet 121 or the second roll sheet 131, control is performed such that a carriage 171 and the conveying roller 163 are operated in cooperation. After the printing, control is performed such that the printed roll sheet is cut by a cutter 181 and discharged to the outside of the apparatus.

Loading of the first roll sheet 121 will now be described in detail. The first roll sheet 121 is rotated counterclockwise (hereinafter also referred to as CCW) by a user to be reeled out. The sheet's leading edge 122 is then inserted into the first supply opening 141. When the first feed sensor 142 detects the sheet's leading edge 122, the first feed roller 143 starts rotating CCW.

The sheet's leading edge 122 is supported by a nip between the first feed roller 143, rotating CCW, and a first pinch roller 144, so that the sheet's leading edge 122 is conveyed. Once the first roll sheet is conveyed by the first feed roller 143, the user moves a hand off the sheet. The sheet's leading edge 122 is then conveyed via the retract sensor 145 toward the printing unit.

The carriage 171 mounts a recording head 173 and a multi-sensor 174 that is a reading unit. The multi-sensor 174 can read sheet information recorded on the roll sheet. The multi-sensor 174 can read the sheet information of the roll sheet while the carriage 171 is on standby in proximity to a home position, waiting for the printing. The carriage 171 is on standby in proximity to the home position when a printing operation and a recovery operation of the recording head 173 are not being performed.

When the sheet's leading edge 122 conveyed by the first feed roller 143 is detected by the conveying sensor 162, the conveying roller 163 starts rotating counterclockwise (CCW). The sheet's leading edge 122 is supported between the conveying roller 163, rotating CCW, and a pinch roller 164, so that the sheet's leading edge 122 is conveyed.

Upon passage of the sheet's leading edge 122 under the multi-sensor 174, the first feed roller 143 and the first pinch roller 144 are separated from each other. At this point in time, the sheet information (hereinafter also referred to as barcode) recorded on the first roll sheet can be read by the multi-sensor 174. The first roll sheet 121 can be printed thereafter and is on standby until a printing command is received. The operation described above is similarly performed when the second roll sheet 131 is inserted from the second supply opening 151.

A description will now be provided with reference to the block diagram in FIG. 3. When the sheet's leading edge 122 has been detected by the retract sensor 145, the controller microcomputer 198 checks the state of the engine 193 to determine that it is possible to convey the sheet's leading edge downstream of the retract sensor 145. Here, the controller microcomputer 198 determines whether the multi-sensor is ready for use. In other words, if a recording operation is being performed on a sheet, or if another sheet is in the convey path, a state in which a reading operation of the sheet information is unavailable (a second state) is determined. Conversely, if the recording operation is not being performed on a sheet and the recovery operation of the recording head is not being performed, a state in which the reading operation of the sheet information is available (a first state) is determined.

The multi-sensor 174 then reads the barcode, which is the sheet information recorded on the sheet at the leading edge thereof. The controller microcomputer 198 provides the engine 193 with a command of a predetermined operation procedure based on the barcode information to allow the engine 193 to continue various operations. If the sheet lacks a barcode, the controller microcomputer 198 notifies the user through the display panel 197 that the sheet information should be input through the operation key 196. Once the sheet information is input, the controller microcomputer 198 issues a command such that the various operations are performed.

Figure 5:
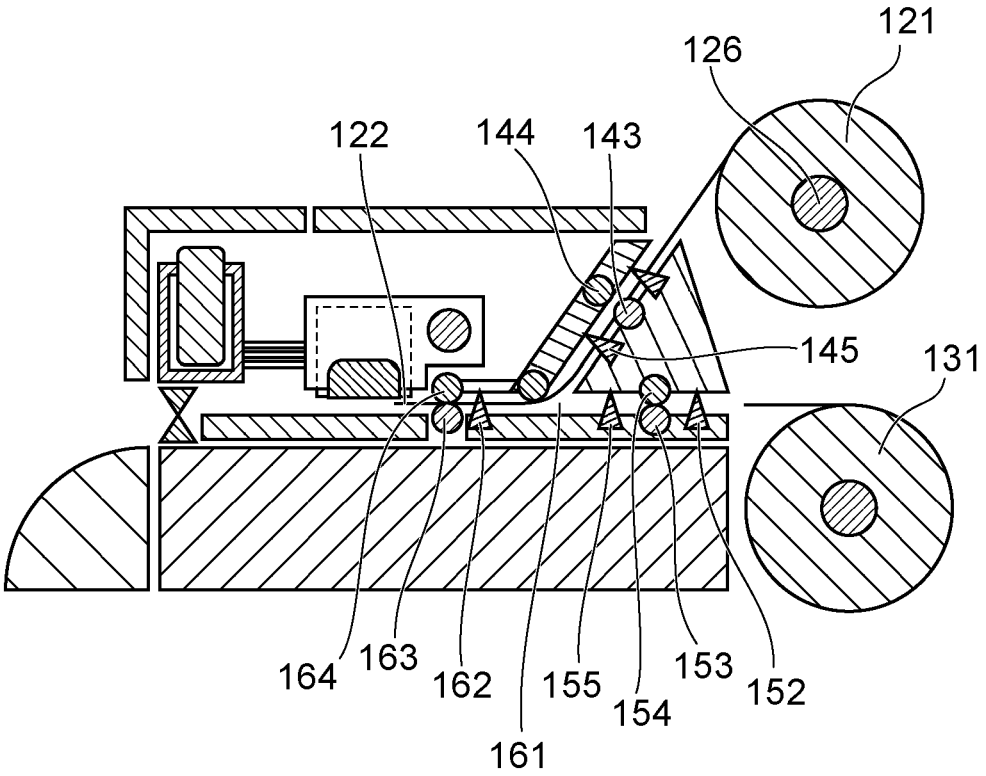
FIG. 5 is a sectional view of the printing apparatus according to the present embodiment.

The first supply path 146 and the second supply path 156 share the convey path downstream of a joining portion 161. With reference to FIG. 5, an operation, performed to insert the second roll sheet 131 into the second supply opening 151 when the first roll sheet 121 has been supplied and reached the printing unit, will now be described. This operation is started when the second feed sensor 152 detects the leading edge of the second roll sheet 131 or when an operation panel 107 in FIG. 1 or the host issues an instruction. The first feed roller 143 and the first pinch roller 144 support the first roll sheet 121 therebetween. The first feed roller 143 and the conveying roller 163 are then rotated clockwise (hereinafter also referred to as CW). When passage of the sheet's leading edge 122 via the conveying sensor 162 has been detected, the rotation of the conveying roller 163 is stopped. Once the passage of the sheet's leading edge 122 via the first retract sensor 145 has been detected, the rotation of the first feed roller 143 is stopped. In the meantime, a roll sheet through shaft 126 is also rotated CW to remove a slack in the first roll sheet 121. After the passage of the sheet's leading edge 122 via the first retract sensor 145 has been detected, the first feed roller 143 is rotated CCW. After the sheet's leading edge 122 has been detected by the first retract sensor 145, the first feed roller 143 is rotated by a predetermined amount and then stopped. By the operation described above, the sheet's leading edge 122 can be stopped before the joining portion 161. Hence, the second roll sheet 131 can be inserted from the second supply opening 151.

A sheet's leading edge 132 of the second roll sheet 131 is inserted into the second supply opening 151 by the user. When the second feed sensor 152 detects the sheet's leading edge 132, the second feed roller 153 starts rotating CCW.

The sheet's leading edge 132 is supported by a nip between the second feed roller 153, rotating CCW, and a second pinch roller 154, so that the sheet's leading edge 132 is conveyed. The sheet's leading edge 132 is then conveyed via the second retract sensor 155 toward the printing unit. The operation thereafter is similar to that of the first roll sheet 121.

Figure 6:
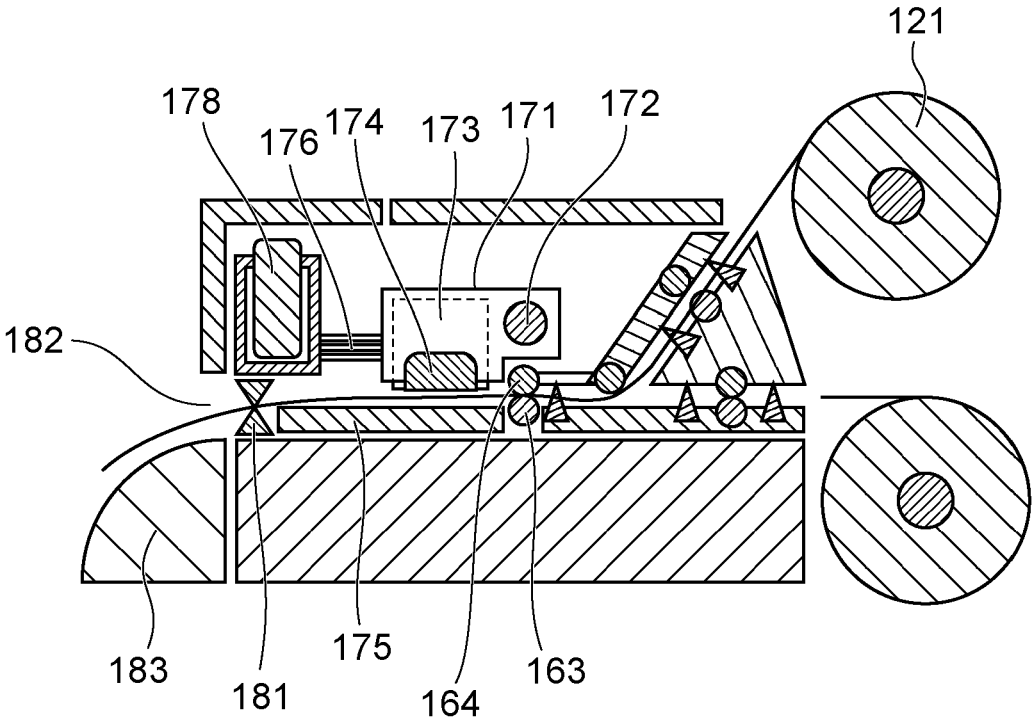
FIG. 6 is a sectional view of the printing apparatus according to the present embodiment.

The printing operation will now be described in detail. With reference to FIG. 6, the carriage 171 moves in a direction perpendicular to a figure. The carriage 171 is guided by a main shaft 172 and a guide rail, now shown, while moving. The carriage 171 mounts the recording head 173 and the multi-sensor 174 thereon. A platen 175, which guides the sheet, is arranged at a position facing the recording head 173.

The recording head 173 includes a plurality of nozzle arrays. An ink tank 178 supplies ink through a tube 176 to the recording head 173. While the carriage 171 moves, the recording head 173 ejects ink toward the sheet conveyed to the printing unit, so as to print an image thereon. The ink ejecting operation from the recording head 173 with the carriage 171 moving, together with the repeated conveying operation of the roll sheet by the conveying roller 163 and the pinch roller 164, allows the image to be printed on the entire sheet. The sheet with the image printed thereon is discharged through a sheet discharge opening 182 to the outside of the apparatus. When the image printing operation is finished, the sheet is conveyed to a predetermined cutting position, so that the sheet is cut by the cutter 181.

Figure 7:
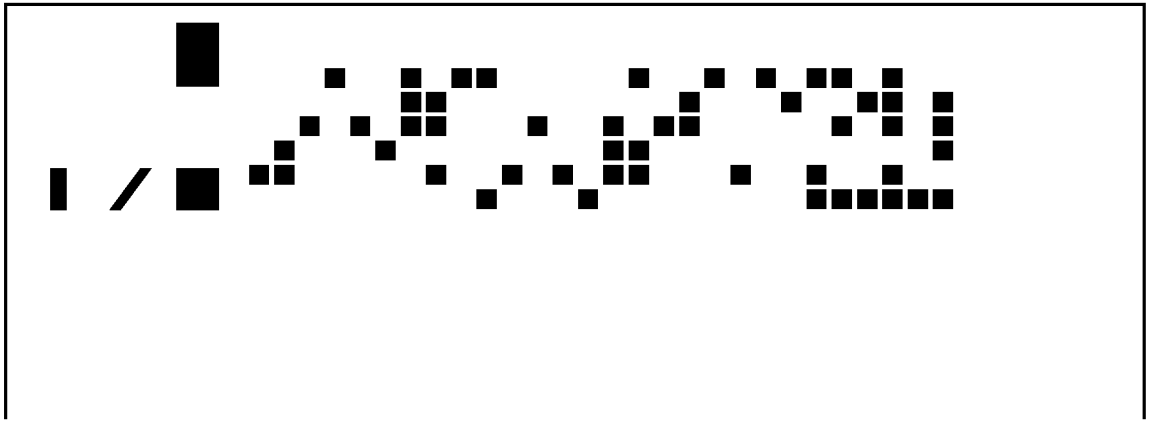
FIG. 7 is a diagram of a pattern of a barcode according to the present embodiment.

When a roll sheet, inserted and reached the printing unit, is reeled in before the roll sheet is removed from the mounting unit, a barcode having the coded sheet information is recorded in proximity to the sheet's leading edge. FIG. 7 is a diagram of the appearance of a pattern of a recorded barcode. A barcode includes a pattern having the form and the state, which are coded, of the sheet. When a barcode is read by the multi-sensor 174, the sheet information, such as the type, the size, and the use history of the sheet, can be identified.

Figure 8:
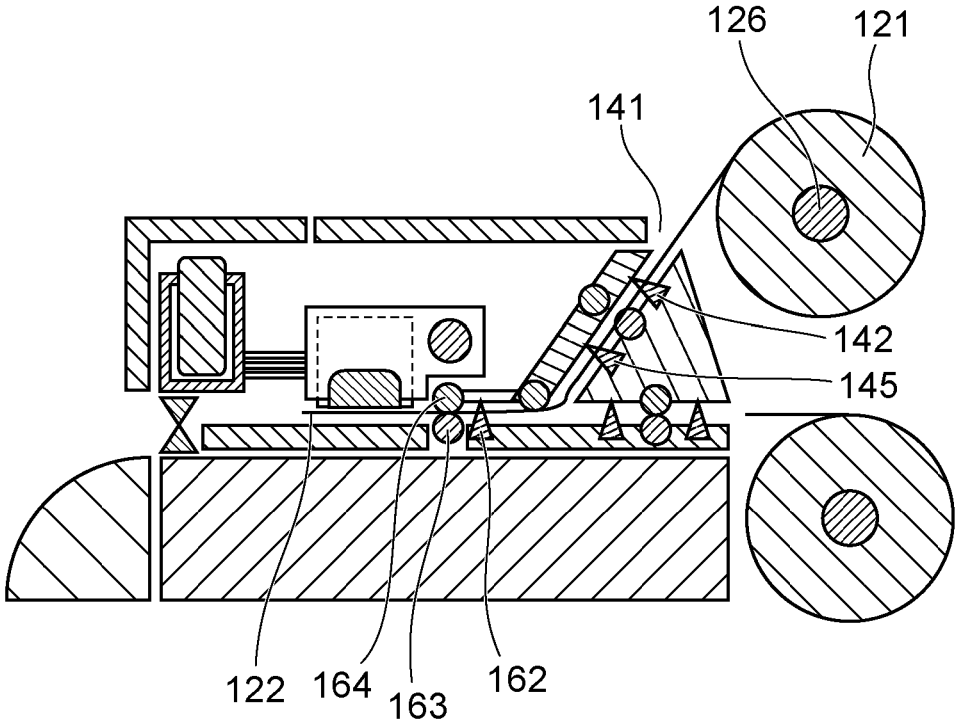
FIG. 8 is a sectional view of the printing apparatus according to the present embodiment.

An operation, performed to remove a roll sheet from the mounting unit, will now be described. With reference to FIG. 8, the conveying roller 163, when rotated CW, conveys the sheet's leading edge 122 in a reverse direction from that of the recording operation. The roll sheet through shaft 126 is also rotated CW to initiate a reel-in operation of the first roll sheet 121. When passage of the sheet's leading edge 122 via the conveying sensor 162 has been detected, the rotation of the conveying roller 163 is stopped. The roll sheet through shaft 126 is rotated CW in order to convey the first roll sheet 121 and thereby to ensure that the sheet's leading edge 122 exits from the first supply opening 141.

Figure 9:
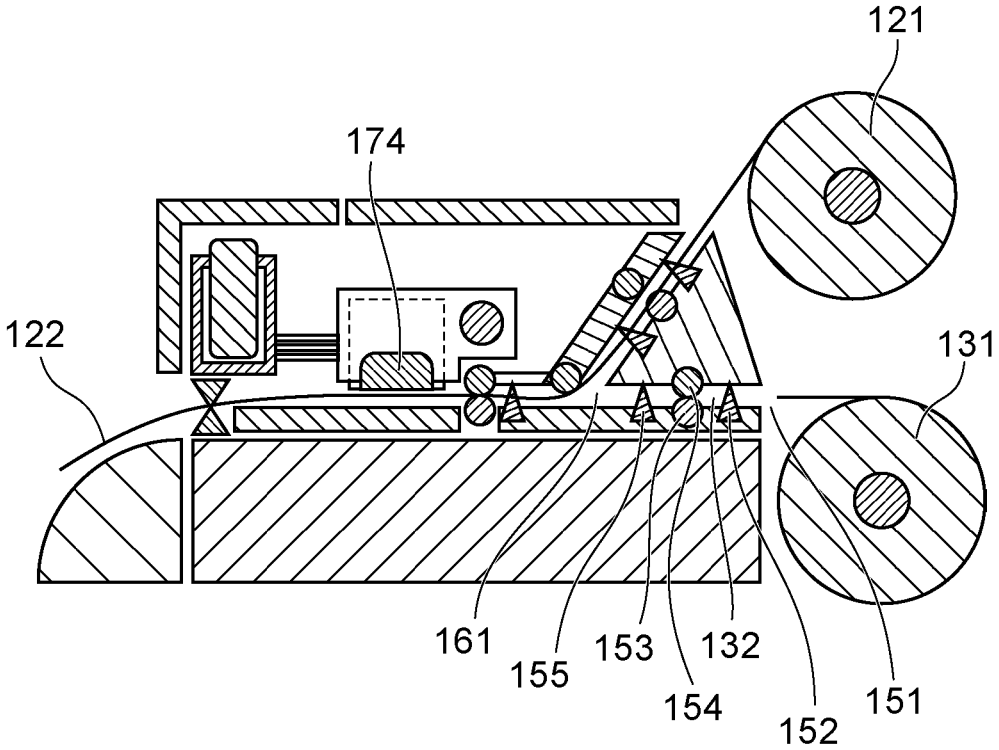
FIG. 9 is a sectional view of the printing apparatus according to the present embodiment.

With reference to FIG. 9, an operation, performed to mount the second roll sheet 131 on the mounting unit while the first roll sheet 121 is being printed, will now be described. The sheet's leading edge 132 of the second roll sheet 131 is inserted into the second supply opening 151 by a user. When the second feed sensor 152 detects the sheet's leading edge 132, the second feed roller 153 starts rotating CCW. The sheet's leading edge 132 is supported by the nip between the second feed roller 153 and the second pinch roller 154, so that the sheet's leading edge 132 is conveyed. Then, after the sheet's leading edge 132 has been detected by the second retract sensor 155, the second feed roller 153 is rotated by a predetermined amount and then stopped. By the operation described above, the sheet's leading edge 132 can be stopped before the joining portion 161.

The second roll sheet 131 cannot be conveyed to a position facing the multi-sensor 174, because the first roll sheet 121 is being printed. Hence, the user will be prompted to input information on the second roll sheet 131 by a notification through display at the operation panel or through sound. The user inputs the information from the operation panel, which allows the operation for mounting the second roll sheet 131 to be completed. In other words, the user can leave the apparatus.

Once the input of the information is acknowledged, the controller microcomputer 198 stores the sheet information, which has been input, in the controller memory 202. The controller microcomputer 198 notifies the completion of the mounting of the second roll sheet on the display panel 197.

In FIG. 9, a sensor for detecting the presence of a barcode may be provided between the second supply opening 151 and the joining portion 161. This sensor may be a relatively inexpensive sensor that is designed to detect the presence of a barcode only. If a barcode is detected by this sensor, the signal notification to prompt an input of the information from the operation panel will not be performed. If the presence of a barcode is detected in this manner, establishment of the information of the second roll sheet 131 can be delayed until the multi-sensor 174 performs the operation to read the barcode. It is also contemplated that, as another configuration, the operation panel provides a notification that the "presence/absence" of a barcode should be checked and input. If "presence" has been input, the establishment of the information of the roll sheet can be delayed. If "absence" has been input, the user is prompted to input the sheet information.

When the printing operation of the first roll sheet 121 has been finished, the sheet's leading edge 122 of the first roll sheet 121 is moved to a retract position. Then, if the second roll sheet 131 has a barcode, the second roll sheet 131 is conveyed to a position in which the barcode faces the multi-sensor 174. The multi-sensor 174 reads the barcode at this position to establish the sheet information of the second roll sheet 131.

With reference to the flowchart of FIG. 10, the sequence of the operation from inserting a roll sheet to completing the mounting thereof will be described.

Figure 10:
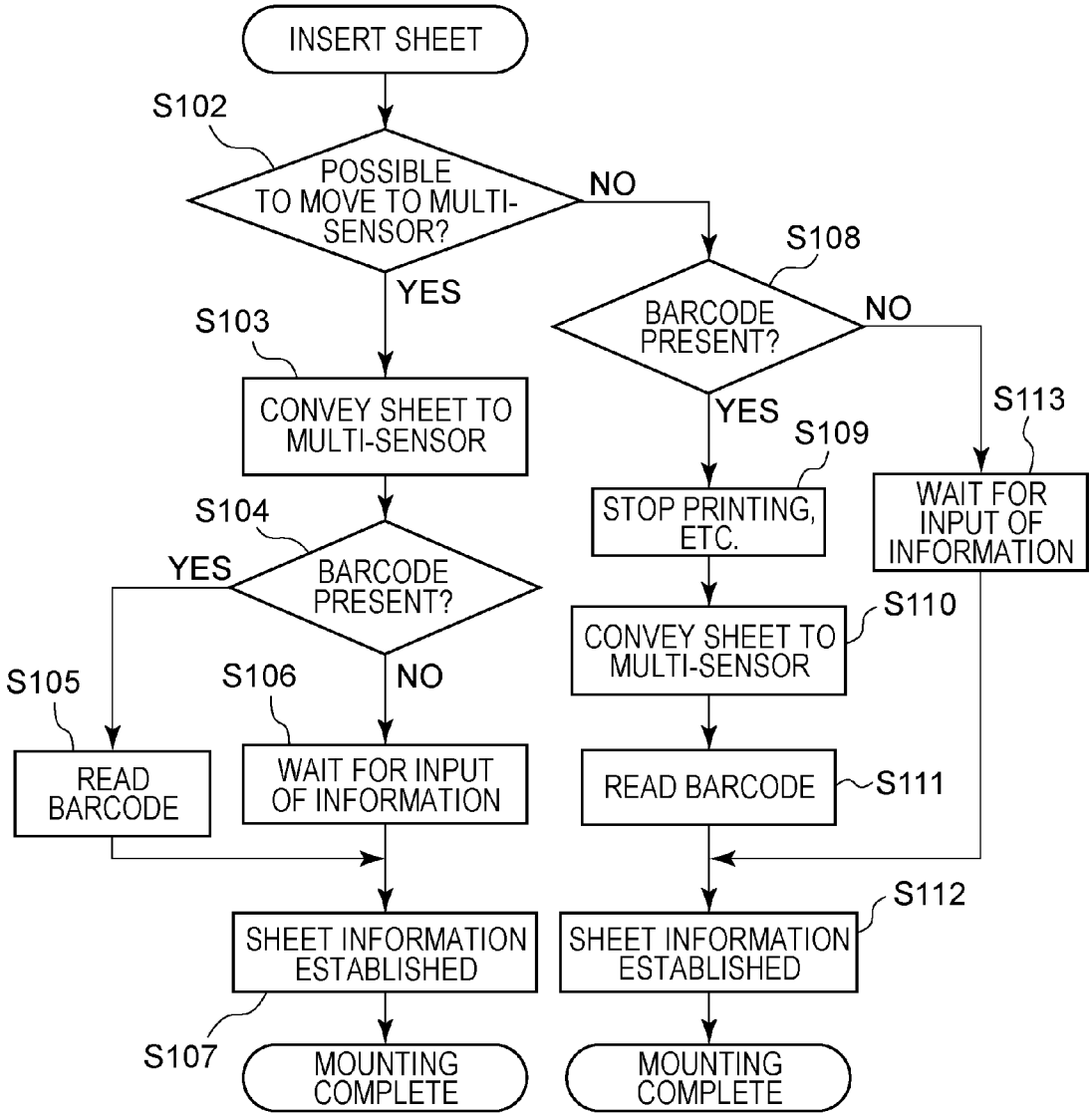
FIG. 10 is a flowchart of a sequence of an operation.

In FIG. 10, when a feed sensor detects a roll sheet that has been inserted from a supply opening, the multi-sensor is checked to see whether the multi-sensor is in a state in which reading is available. It is determined whether the sheet should be conveyed to a position facing the multi-sensor (S102). If the multi-sensor is in the state in which the reading is available, the sheet is conveyed to the position facing the multi-sensor (S103). The multi-sensor then determines the presence of a barcode (S104). If a barcode is present, the multi-sensor reads the barcode (S105). The sheet information of the roll sheet is thus established (S107).

If it is determined, in S104, that a barcode is not present, an input of the sheet information from the operation panel is requested (S106). When the sheet information is input, the controller memory 202 stores the sheet information and the sheet information is established (S107).

If it is determined, in S102, that the multi-sensor is in a state in which the reading is unavailable, the presence of a barcode is determined (S108). If a barcode is present, the printing operation and the recovery operation of the recording head are stopped (S109). If another roll sheet, inserted from another supply opening, is being printed, the printing operation on the other roll sheet is interrupted and the other roll sheet is conveyed in the reverse direction such that the sheet's leading edge is at the retract position. The roll sheet, which has a barcode as determined in S108, is then conveyed to the position facing the multi-sensor (S110). The multi-sensor reads the barcode (S111). The sheet information read by the multi-sensor is stored in the controller memory 202 and the sheet information is established (S112).

If it has been determined, in S108, that a barcode is not present, an input of the sheet information from the operation panel is requested (S113). When the sheet information is input, the controller memory 202 stores the sheet information and the sheet information is established (S112).

As described above, two timings are used in a manner dependent on a status to enable a roll sheet to be mounted at any timing that a user chooses regardless of the state of the printer.

An exemplary modification may be configured to allow a user to set, from the operation panel, the reading of a barcode to "perform" or "not perform".

If "perform" is selected for the reading, the operation by the multi-sensor to read the barcode will be performed.

If "not perform" is selected for the reading, a request for an input of the sheet information from the operation panel by the user is notified immediately after the roll sheet is inserted, regardless of the presence of a barcode. The sheet information is established at this point in time.

With reference to the flowchart of FIG. 11, the sequence of the operation from inserting a roll sheet to completing the mounting thereof will be described.

Figure 11:
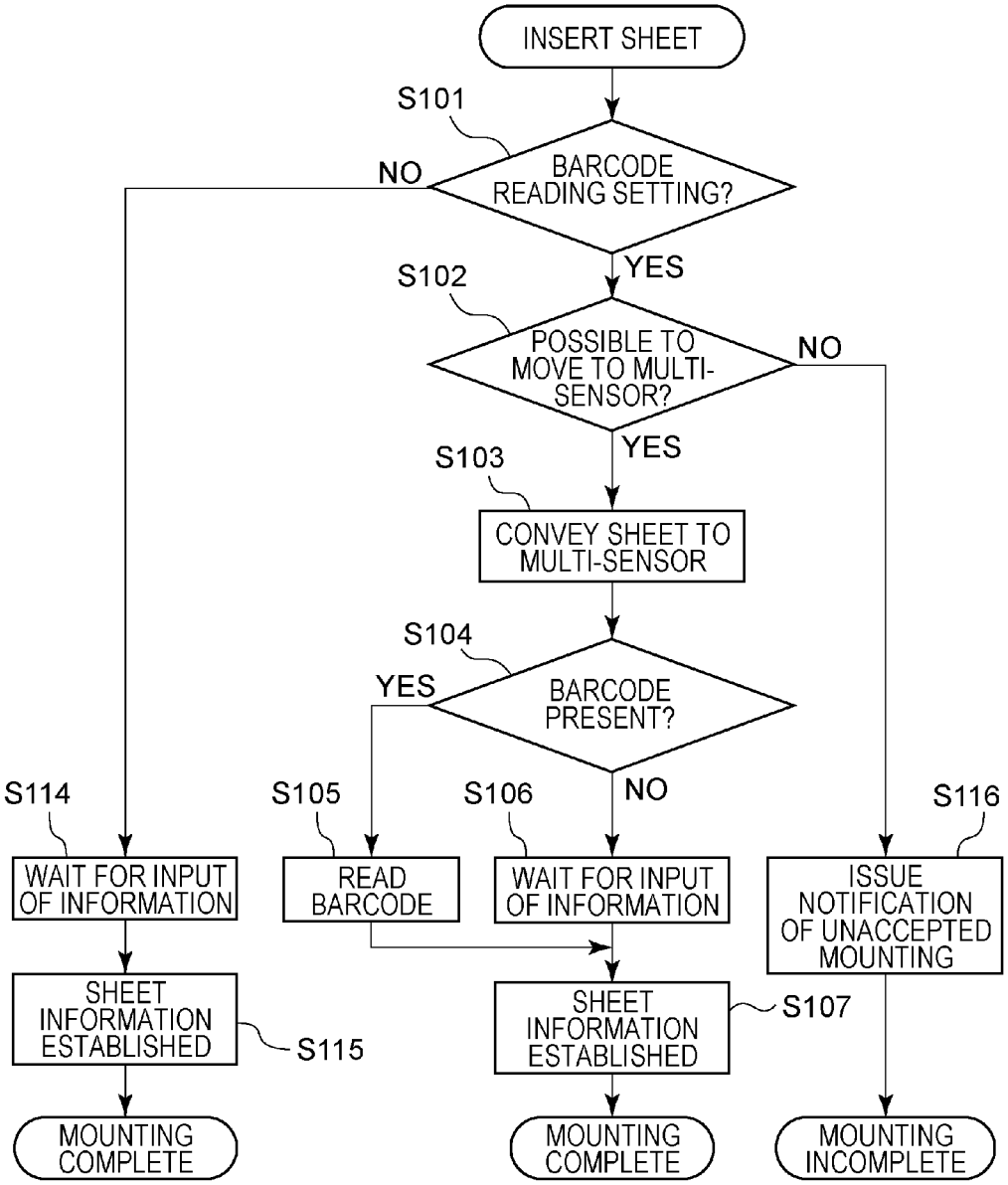
FIG. 11 is a flowchart of a sequence of an operation.

In FIG. 11, when a feed sensor detects a roll sheet that has been inserted from a supply opening, the setting is checked to see whether a barcode should be read (S101). If the setting allows a barcode to be read, the multi-sensor is checked to see whether the multi-sensor is in the state in which the reading is available (S102). If the multi-sensor is in the state in which the reading is available, the sheet is conveyed to the position corresponding to the multi-sensor (S103). The multi-sensor then determines the presence of a barcode (S104). If a barcode is present, the multi-sensor reads the barcode (S105). The sheet information of the roll sheet is thus established (S107).

If it is determined, in S104, that a barcode is not present, an input of the sheet information from the operation panel is requested (S106). When the sheet information is input, the controller memory stores the sheet information and the sheet information is established (S107).

If it is determined, in S102, that the multi-sensor is in the state in which the reading is unavailable, an input of the sheet information is requested. If an input of the sheet information is not provided, the operation panel issues a notification that a roll sheet is not accepted for mounting (S116).

If, in S101, the setting does not allow a barcode to be read, an input of the sheet information from the operation panel is requested (S114). When the sheet information is input, the controller memory 202 stores the sheet information and the sheet information is established (S115).

As described above, the present embodiment provides an effective specification for a user who knows that a roll sheet lacks a barcode.

The embodiments described above provide two separate timings, dependent on a status, for inputting the sheet information (the type and the size of a roll sheet) from the operating unit. As a first timing, when the printer has performed the reading of a barcode of a roll sheet, and if the sheet lacks a barcode, a user is notified that an input should be provided. A condition for selecting this timing is that, for example, when the second roll sheet is to be mounted, the first roll sheet is already mounted but is being retracted to a position that precludes an effect on the printing operation, and the reading by the sensor mounted on the carriage is available. This, of course, includes a case in which the preceding roll sheet is not mounted. As a second timing, a user is, in advance, notified that an input should be provided, before the printer performs the reading of a barcode of a roll sheet. A condition for selecting this timing is that, for example, when the second roll sheet is to be mounted, the first roll sheet is already mounted and is being printed, and thus the reading by the sensor mounted on the carriage is unavailable. In a certain type of printer, the reading by the sensor may be unavailable in a similar manner described above when the printing is not performed. This is also applicable as the condition described above. This refers to a case in which the carriage is in operation for another purpose, such as a cleaning operation performed as planned by a wiper, to clean an ejecting surface of an inkjet head, and a preliminary ejecting operation to alleviate clogging of an ejection opening. By using the two timings in a manner dependent on a status as described above, a roll sheet can be mounted at any timing that a user chooses regardless of the state of the printer. Hence, the user does not have to wait around near the printer while the printing is ongoing, nor does the user, away from the printer, have to worry about when the printing is finished. Accordingly, the user can direct an undivided attention to another job. In addition, in every case, the information in demand for the roll sheet has been input, which eliminates a manual reel-in operation due to an insufficient procedure up to the completion of the mounting.

In the embodiments described above, when the sheet information is input by a user from the operation panel, the reading of a barcode by the multi-sensor is not performed, and the information that has been input is stored in the memory to establish the sheet information. This is, however, not limiting, and even when the sheet information is input from the operation panel, the multi-sensor may then read a barcode. In this case, if the input information and the read information are different from each other, the input information may be given priority, causing the input information to remain in the memory, or the read information may be given the priority, causing the input information stored in the memory to be replaced by the read information. Alternatively, the user may be notified of the difference between the input information and the read information and prompted to select the correct information through the operation panel.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-082680, filed Mar. 30, 2012, which is hereby incorporated by reference herein in its entirety.

What is claimed is:

1. A printing apparatus comprising:

a first mounting unit on which a first sheet is mounted;

a second mounting unit on which a second sheet is mounted;

a reading unit configured to read sheet information printed on the first sheet or the second sheet;

a convey unit configured to convey the first sheet or the second sheet;

a determining unit configured to determine whether the printing apparatus is in a first state in which the first sheet is not being conveyed by the convey unit or a second state in which the first sheet is being conveyed by the convey unit; and a control unit configured, in response to the determination that the printing apparatus is in the first state, to cause the convey unit to convey the second sheet to the reading unit, and in response to the determination that the printing apparatus is in the second state, to provide a notification to prompt an input of the sheet information of the second sheet.

2. The printing apparatus according to claim 1 further comprising a memory for storing the sheet information.

3. The printing apparatus according to claim 1, further comprising a sensor for detecting the sheet information on the second sheet, wherein if the sensor detects the sheet information, the control unit does not provide the notification to prompt an input of the sheet information in the second state.

4. The printing apparatus according to claim 3, wherein if the sensor detects the absence of the sheet information, the control unit provides the notification to prompt an input of the sheet information in the second state.

5. The printing apparatus according to claim 3, wherein, in the second state and when the sensor has detected the absence of the sheet information, the control unit waits until the first state is established and then enables the reading unit to read the sheet information.

6. The printing apparatus according to claim 5, wherein, when a printing operation being performed on the first sheet completes, the control unit enables the reading unit to read the sheet information of the second sheet.

7. The printing apparatus according to claim 1, further comprising:

a printing head configured to print on the first sheet or the second sheet; and a carriage configured to move with the printing head mounted thereon, wherein the reading unit is mounted on the carriage.

* * * * *